United States Patent [19]

Dumesnil

[11] 4,070,087

[45] Jan. 24, 1978

[54] CONNECTING DEVICE FOR ENSURING STABLE ELECTRICAL CONNECTIONS

[75] Inventor: Gerard Paul Louis Dumesnil, Epinay, France

[73] Assignee: Electronic & Technology, Boulogne, France

[21] Appl. No.: 730,636

[22] Filed: Oct. 7, 1976

[30] Foreign Application Priority Data

Oct. 13, 1975 France ..... 75 31247

[51] Int. Cl.[2] ..... H01R 11/28

[52] U.S. Cl. ..... 339/205; 339/248 R; 339/273 R; 339/276 R

[58] Field of Search ..... 339/205, 244 R, 248 R, 339/248 S, 249 R, 273 R, 273 F, 276 R, 276 A, 276 S

[56] References Cited

U.S. PATENT DOCUMENTS

| | | | |
|---|---|---|---|
| 2,143,645 | 1/1939 | Carson | 339/205 |
| 2,999,223 | 9/1961 | Peter | 339/205 |
| 3,594,715 | 7/1971 | Dumesnil | 339/244 R |

*Primary Examiner*—Joseph H. McGlynn
*Assistant Examiner*—Mark S. Bicks
*Attorney, Agent, or Firm*—George B. Oujevolk

[57] ABSTRACT

A connecting device for establishing stable electrical connections for interconnecting at least two conductors, this device ensuring both the conduction between the conductors and the mechanical assembly. The device comprises a terminal element having a tubular guide in which there is engaged one of the conductors an adjacent sleeve which receives the bared end of this conductor after it has been folded 180°, and a tongue of conductive material which partly penetrates the sleeves of at least two contiguous connecting terminal elements so as to achieve the electrical junction between the conductors carried by said terminal elements. The tongue comprises at least one retaining point which co-operates with a complementary cavity located in the sleeve, whereby the tongue which achieves the electrical conduction also ensures the locking of the conductors by a simple clipping in the connecting terminal elements.

7 Claims, 4 Drawing Figures

CONNECTING DEVICE FOR ENSURING STABLE ELECTRICAL CONNECTIONS

Figure 1:
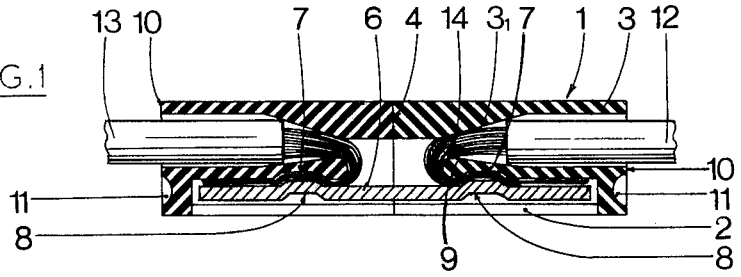

The invention relates to a connecting device for ensuring stable electrical connections and in particular for interconnecting at least two conductors, this device ensuring both the conduction between the considered conductors and the mechanical assembly thereof.

There is known, in particular from the French Certificate of Addition No. 69 18 017 of June 2, 1969, attached to the French Pat. No. 1 581 541 of May 22, 1968, both the property of the applicant, a connecting device comprising two identical terminal elements, each comprising a tubular guide in which there is engaged one of the conductors to be connected and an open or closed sleeve adjacent the tubular guide, the electrical connection between the two terminal elements which are in facing relation being ensured by a tongue or strip of conductive material. The connecting process comprises therefore, in starting with such a device, baring the end of each conductor and then introducing each end in the tubular guide of its respective terminal element, after which the bared end is folded at 180° so that this end enters the sleeve adjacent the guide, the two thus prepared terminal elements are thereafter mechanically assembled by the junction tongue which penetrates to equal extents the sleeves of the two contiguous terminal elements, the electrical continuity being achieved by the tongue which performs the function of a bridge between the bared strands of the two considered conductors.

According to said Certificate of Addition, the tongue may be in part conductive and in part dielectric or may be in a complex form for the interconnection of four or more conductors. Lastly, the electrical insulation may be achieved in this type of device by means of a U-section cap which covers the visible region of the tongue and clips onto the connection terminal elements.

This device provides many advantages but has, however, the disadvantage of not affording a sufficient guarantee against pulling apart, so that an accidental disconnection of the conductors could occur which breaks the electrical connection.

Moreover, it has been found that the assembly of the conductors and terminal elements is not always easy owing to the fact that the conductor can freely move in the connecting terminal element, so that nothing opposes the uncoupling of said terminal elements.

An object of the invention is to overcome these drawbacks.

According to the invention, there is provided a connecting device for establishing electrical connections, in particular for interconnecting at least two conductors, comprising a terminal element having a tubular guide in which there is engaged one of the conductors an adjacent sleeve which receives the bared end of said conductor after it has been folded 180°, and a tongue of conductive material which partly penetrates the sleeves of at least two contiguous connecting terminal elements for achieving the electrical junction between the conductors carried by said terminal elements, wherein the tongue comprises at least one retaining point which co-operates with a complementary cavity located in the sleeve so that the tongue which achieves the electrical conduction also ensures the interlocking of the conductors by a simple clipping in the connecting terminal elements.

According to one embodiment, the tongue comprises two retaining points for double clipping in the corresponding cavities of the sleeves of two contigous terminal elements.

According to another embodiment, the two retaining points are in the form of bosses having different radii of curvature.

Figure 2:
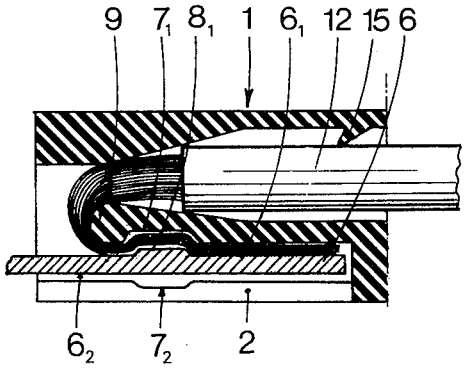
Figure 3:
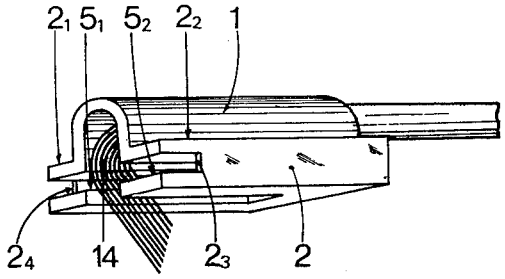
Figure 4:
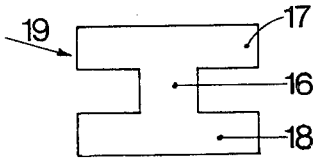

A connecting device according to the invention is shown by way of a non-limitative example in the accompanying drawing in which:

FIG. 1 is a sectional view of two contiguous terminal elements which are electrically and mechanically interconnected by a tongue, FIG. 2 is a partial sectional view of another embodiment of the tongue, FIG. 3 is a perspective view of one of the terminal elements of the connecting device, and FIG. 4 is a plan view of a tongue having a plurality of connecting tabs.

The connecting device as illustrated in the accompanying drawing is intended more particularly for electrical connections between two conductors. It concerns, therefore, a wire-wire connection, although this device could be employed for ensuring a connection between a simple electrical conductor and another conductor provided for example with a flat male plug.

This connecting device comprises two terminal elements of insulating material preferably obtained by injection moulding. Each terminal element co-operates with one of the conductors to be connected and the mechanical connection or assembly of the two terminal elements is achieved by means of a tongue or strip which in addition ensures the electrical continuity between the two conductors.

For reasons of clarity a single terminal element will be described, it being understood that they are all identical.

The terminal element has a tubular guide 1 which extends throughout its length and an adjacent sleeve 2 which is parallel thereto, this sleeve extending also, in the presently-described embodiment, throughout the length of the tubular guide.

As illustrated in FIG. 3, the tubular guide has a substantially circular cross-sectional shape and defines a bore 3 having a rectilinear portion of constant diameter and a frustoconical portion $\mathbf{3_1}$, the latter being oriented in the direction of the front face 4 of the assembly with a contiguous terminal element. This frustoconical portion has preferably a polygonal cross-sectional shape so as to form a veritable constriction against which the insulating sheath of the conductor abuts, this polygonal cross-sectional shape already promoting in this region the spreading of the strands of said conductor.

The sleeve 2 (FIG. 3) is wholly or partly split or provided with a sealing lip as is the case in the French Pat. No. 1 581 541 of May 22, 1968. In the considered embodiment, this sleeve is split throughout its length and is constituted by two flanges $\mathbf{2_1}$ and $\mathbf{2_2}$ provided internally with grooves $\mathbf{5_1}$ and $\mathbf{5_2}$ in which the tongue 6 will be disposed. The flanges $\mathbf{2_1}$ and $\mathbf{2_2}$ of this sleeve further comprise lateral openings the depth of which substantially corresponds to the width of a semi-tongue so as to allow the passage of the junction region 16 interconnecting the two lateral parts 17–18 of a double tongue 19 having an H-shape in plan (FIG. 4) for the electrical and mechanical junction of at least two juxtaposed terminal elements. Another feature of this sleeve is that it is provided internally with at least one cavity having a shape and dimensions coresponding to the retaining point with which the tongue 6 is provided.

This tongue, which is known per se, has the feature of indeed comprising at least one retaining point or boss 8 which may be obtained either by a press-forming operation as shown in FIG. 1 or by moulding, stamping or extrusion.

In the embodiment shown in FIG. 1, the tongue 6 has two retaining points 8 the shape and dimensions of which are complementary to cavities 7 provided inside the sleeves of the terminal elements. This tongue, which is necessarily of a conductive material, may also be flexible so that it more strongly compresses the strands of the conductors to be connected. The retaining points 8 of the tongue may be identical or different in their shape and dimension. If it concerns, for example, two bosses extending transversely of the length of the tongue, these bosses may be of different radii of curvature so as to obtain a differential anchoring of the terminal elements, so that, upon separation, it is preferably the terminal element connected to the source of current which is the first to separate, if it is of course arranged to introduce in this terminal element the end of the tongue provided with the smallest retaining point. This arrangement very greatly improves the safety upon uncoupling under voltage.

The tongue 6 may, as shown in FIG. 2, have on its face $6_1$ a retaining point $8_1$ while the other face $6_2$ is planar. This type of tongue may be obtained preferably by stamping or moulding. Likewise, the tongue may have only a single retaining point (contrary to the arrangement shown in FIG. 1), so that one of the terminal elements according to invention may be coupled with a different terminal element which has not been arranged to receive tongues having retaining points.

In one embodiment, shown in FIG. 2, the sleeve 2 has two cavities $7_1$ and $7_2$, the latter being disposed in facing relation to each other and having different dimensions. This arrangement has been provided to make it possile to employ, for the same terminal element, a range of conductors of different diameters. Indeed, with a relatively large wire diameter, the tongue will be introduced in the position shown in FIG. 2, whereas if it concerns a conductor of smaller diameter, the tongue will be turned round so that its retaining point $8_1$, will engage in the cavity $7_2$, the thickness of the tongue being in this case sufficient to ensure a good electrical contact. Indeed, as the depth of the cavity $7_2$ is less than the height of the boss $8_1$, the tongue bearing in this cavity be its boss will be raised in the direction of the conductor and thus reduce the gap between the tongue and this conductor. It will be observed in this respect that the lip 9 separating the tubular conduit 1 from the sleeve 2 is relatively flexible, so that it is capable of deforming when a conductor of larger diameter is employed, the elasticity proper to this lip promoting the electrical contact.

The terminal elements have on their rear face part 10 cavities 11 in the form of grooves intended to permit the assembly of a plurality of sets of terminal elements on the same support strip provided with clipping means.

The electrical connection by means of the terminal elements according to invention is achieved in the following manner:

The operator bares the end of the two conductors 12 and 13 to be connected and then engages each conductor in the tubular guide 1 of the terminal element until this bared end 14 projects from the front face 4 of said terminal element. It is necessary at this moment to pull on the conductor, or shift the terminal element, until the front end of the sheath abuts the frustoconical wall 3 of the tubular guide. At this stage the conductor is stopped and can no longer move axially forwardly in this direction The operator then folds the bared end 14 of the conductor 180° so as to form a hairpin-shaped turn, the latter then being engaged in the cavity of the sleeve 2. When the two conductors have thus been rendered integral with their respective terminal element, they are mechanically and electrically assembled by means of the tongue 6 which penetrates to equal extents in the two sleeves of the two contiguous terminal elements which are thus made to bear against each other. The mechanical locking of the terminal elements and the conductors retained thereby is ensured by the clipping of the retaining points 8 of the tongue in the complementary cavities 7 of the sleeves of the terminal elements. This clipping is promoted by the elasticity of the tongue and will be the more effective as the retaining points are large. It will be clear that any shape and dimensions may be given to these retaining points and that these retaining points may be multiplied in the form of teeth or grooves if a more definite anchoring is desired. This anchoring may be still further improved in providing inside the tubular guide 1 lugs 15 which are oriented toward the front face of the terminal elements, these lugs having a certain flexibility so as to, in one hand, permit the introduction of the conductor and, on the other hand, oppose its withdrawal by partial engagement in the insulator of said conductor. With this form of terminal element, a particularly effective electrical contact can thus be achieved, since the surface of contact between the tongue and conductor is increased while achieving a mechanical assembly resisting a pulling-apart and consequently an accidental uncoupling.

By the different designs of the tongue it is possible to obtain a differential anchoring, as mentioned hereinbefore, or the assembly of a terminal element according to invention with another different terminal element.

It must be understood that the invention is not intended to be limited to the embodiments described hereinbefore in respect of which other arrangements may be envisaged without departing from the scope of the invention definded in the claims.

I claim:

1. A connecting device for establishing electrical connection between at least two conductors, comprising:

a. a pair of terminal elements each having a flat front face (4) for juxtapositioning with and connecting to the other terminal element, and a cylindrically-shaped longitudinal tubular guide (3) in which one of the conductors (12) is to be inserted;

b. a longitudinal flat sleeve (2) adjacent each said longitudinal cylindrically-shaped guide to receive the bared end (14) of one conductor (12) after it has been folded in a hairpin turn, each sleeve (2) having at least one cavity (8) therein; and, c. a tongue (6) of conductive material which partly penetrates the sleeves (2) of said terminal elements when the faces thereof are juxtapositioned for producing the electrical junction between the conductors inserted in the two juxtapositioned terminal elements, said tongue (6) having at least two retaining points (8) which cooperate with and are complementary to said cavities (8) so that the tongue while achieving electrical connection also ensures the locking of the conductors by clipping together opposed terminal elements.

2. A connecting device as claimed in claim 1, wherein the two retaining points are in the form of bosses having different radii of curvature.

3. A connecting device as claimed in claim 1, wherein each sleeve of each terminal element comprises two confronting cavities, said cavities being of different dimensions or depths.

4. A connecting device as claimed in claim 1, wherein the inner end of each tubular guide of each terminal element has a polygonal-section frustoconical portion in the vicinity of the fold region of one of the conductors so as to prevent them from moving axially forwardly, the rearward displacement being rendered impossible by at least one lug projecting inside each tubular guide and by the hairpin fold of the bared end of each conductor.

5. A connecting device as claimed in claim 1, wherein the terminal elements have on their rear end faces cavities for receiving assembling means for uniting a series of terminal elements.

6. A connecting device as claimed in claim 1, wherein each sleeve is at least partly longitudinally split so as to define two lateral flanges which are in facing relation and have on the front face of each terminal element openings the depth of which is substantially equal to the length of half the tongue.

7. A connecting device as claimed in claim 6, wherein the tongue is cut from an electrically conductive sheet material and is planar in shape and has a plurality of connecting tabs.

* * * * *